US006234466B1

(12) United States Patent
Infanger

(10) Patent No.: US 6,234,466 B1
(45) Date of Patent: May 22, 2001

(54) METHOD OF INSERTING PRINTED PRODUCTS INTO A FOLDED MAIN PRODUCT

(75) Inventor: Rudolf Infanger, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/355,578

(22) PCT Filed: Jan. 22, 1998

(86) PCT No.: PCT/CH98/00021

§ 371 Date: Jul. 30, 1999

§ 102(e) Date: Jul. 30, 1999

(87) PCT Pub. No.: WO98/33656

PCT Pub. Date: Aug. 6, 1998

(30) Foreign Application Priority Data

Jan. 31, 1997 (CH) ..... 0220/97

(51) Int. Cl.[7] ..... B42B 2/00

(52) U.S. Cl. ..... 270/52.23; 270/56; 270/52.19; 270/52; 270/52.25

(58) Field of Search ..... 270/52.2, 52.23, 270/52.19, 56, 52.25, 52, 5, 52.27

(56) References Cited

U.S. PATENT DOCUMENTS

| | | | | |
|---|---|---|---|---|
| 1,659,099 | | 2/1928 | Halvorsen . | |
| 2,253,556 | | 8/1941 | Christensen . | |
| 2,796,255 | * | 6/1957 | Mitchell | 270/52 |
| 3,951,399 | | 4/1976 | Reist | 270/58 |
| 4,133,521 | * | 1/1979 | Muller | 270/55 |
| 4,416,448 | * | 11/1983 | Meier | 270/52.2 |
| 4,477,067 | * | 10/1984 | Wise | 270/52.2 |
| 4,723,770 | * | 2/1988 | Seidel et al. | 270/52.2 |
| 4,743,005 | * | 5/1988 | Reist | 270/52.22 |
| 4,867,429 | * | 9/1989 | Infanger | 270/52.2 |
| 4,901,993 | | 2/1990 | Hänsch | 270/21.1 |
| 4,997,205 | | 3/1991 | Hänsch | 281/2 |
| 5,050,851 | | 9/1991 | Eugster | 270/55 |
| 5,082,256 | * | 1/1992 | Bryson | 270/55 |
| 5,112,036 | * | 5/1992 | Hatt | 270/52.23 |
| 5,165,674 | * | 11/1992 | Petersen | 270/47 |
| 5,171,005 | * | 12/1992 | Manley et al. | 270/1.02 |
| 5,186,443 | * | 2/1993 | Manley et al. | 270/1.02 |
| 5,188,349 | * | 2/1993 | Honegger | 270/52.22 |
| 5,419,541 | * | 5/1995 | Stevens | 270/52.19 |
| 5,823,320 | * | 10/1998 | Seidel et al. | 198/803.5 |

FOREIGN PATENT DOCUMENTS

0911289A1 * 10/1997 (EP) .

* cited by examiner

*Primary Examiner*—Douglas Hess
*Assistant Examiner*—Richard Ridley
(74) *Attorney, Agent, or Firm*—Brinks Hofer Gilson & Lione

(57) ABSTRACT

A method of combining a number of individually printed products into a finished product, for example a weekend newspaper containing numerous sections. The individually printed products are of the type that are folded at their mid portion so that they can be opened along the fold allowing them to receive other printed product or closed which facilitates their insertion into an opened printed product. The process starts by inserting a folded printed product into the main product. The first inserted product could have been open when inserted or opened after it was inserted. Then another printed product is inserted into the main product such that it lies adjacent to the first product that was inserted. The first product that was inserted into the main product can then be opened to permit additional printed products to be inserted into it.

Figure 1:
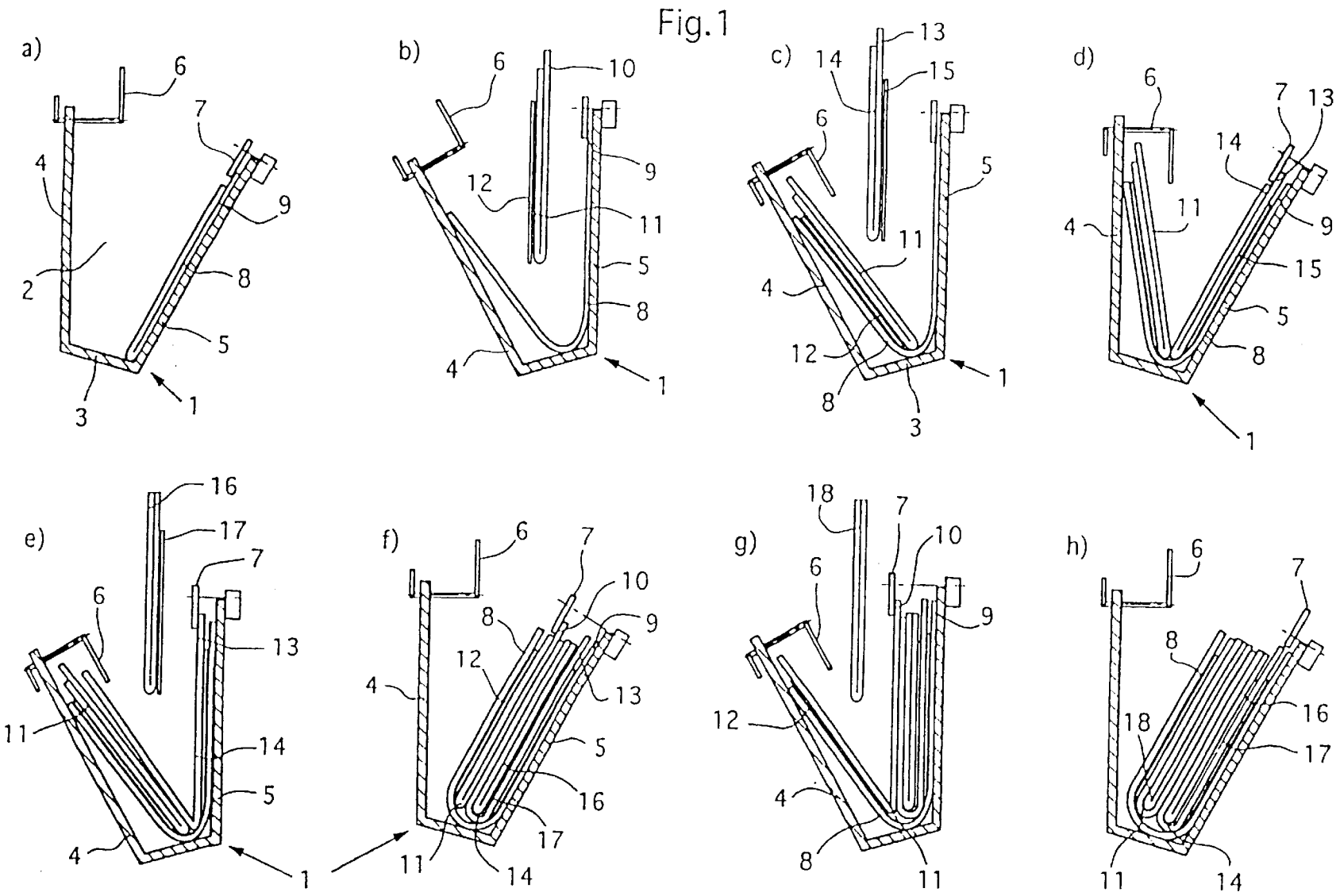

26 Claims, 5 Drawing Sheets a)
b)
c)
d)
e)
f)
g)
h)
A
1
2
3
4
5
19
20
21
22
23
24
25
26
27
28
29

METHOD OF INSERTING PRINTED PRODUCTS INTO A FOLDED MAIN PRODUCT

The invention relates to a method of inserting printed products into a folded main product, in the case of which at least one printed product which is formed as a folded preprinted product and then further printed products are inserted.

Such methods are used in order to put together the different printed products in a respectively desired manner to form any desired printed material, in particular newspapers and periodicals.

The disadvantage with the known methods is the fact that the freedom for structuring printed material is limited, so that technical limitations mean that it is not always possible, in particular, to put together newspapers, comprising a main product, at least one preprinted product and a plurality of inserts, in the desired structure.

An object of the invention is to develop a method of the type mentioned in the introduction such that, in the operation of putting together printed material, in particular newspapers, there is greater flexibility as far as the various possible ways of structuring the printed material are concerned.

This object is achieved according to the invention in that the folded preprinted product is inserted into the folded main product in the closed state, or is closed following the insertion operation, and subsequently at least one further printed product, which comes to rest alongside the closed preprinted product, is inserted, whereupon the preprinted product is opened and, finally, at least one further printed product is inserted into the preprinted product.

In the case of the most straightforward embodiment of the method according to the invention, a preprinted product is thus inserted into the main product, whereupon, for example, an insert is inserted alongside the closed preprinted product. The preprinted product is then opened and, for example, a further insert is inserted into the open preprinted product.

In contrast to the hitherto known methods, in the case of which either the preprinted product has to be inserted into the main product with an insert already contained therein, which requires so-called preliminary insertion with a separate preliminary-insertion apparatus, or the insertion of the insert intended for the preprinted product has to take place immediately following the insertion of the preprinted product into the main product, the method according to the invention is distinguished in that, following the insertion of the preprinted product, which does not yet contain the respective insert, it is possible to carry out any other desired insertion operations before, finally, the desired insertion operations relevant to the preprinted product are carried out and certain inserts are inserted into the preprinted product. Consequently, in terms of the point in time and the location of the insertion of an insert into the preprinted product, the use of the method according to the invention provides much more freedom than the prior art.

It is particularly preferred if, according to the invention, a first folded preprinted product is inserted in the closed state, or is closed following the insertion operation, and subsequently at least a second folded preprinted product, which comes to rest alongside the closed, first preprinted product, is inserted and, in turn, has at least one further printed product inserted in it, whereupon the first preprinted product is opened and, finally, at least one further printed product is inserted into the first preprinted product.

In the case of this embodiment of the method according to the invention, it is thus possible, for example, for the first preprinted product to be arrested without an insert being inserted therein, whereupon the second preprinted product is inserted. An arrested printed product or main product is intended to mean a part, or the entire respective product, retained in a defined position. In order to arrest a product, it is made of retaining elements which are fixed statically or can be moved in a controllable manner and, in particular in one state, retain a product in a defined position and, in the other state, have no direct influence on the position of the product, with the result that the product assumes a position of its own accord, for example, as a result of the action of gravitational force. By virtue of the arresting operation, a printed product may be held either open or closed in a controllable manner. Following the insertion of the second preprinted product, one or more inserts are inserted into the latter, whereupon the first, arrested preprinted product is opened and inserts can be inserted into said first preprinted product. This makes it possible to produce printed material or a newspaper in the case of which two preprinted products which are located one beside the other, and in which in each case further preprinted products or inserts are located, are arranged in a main product. It is not necessary here for the inserts which are intended for the first preprinted product to be inserted into the preprinted product immediately following the insertion of the preprinted product into the main product. Insertion of the inserts into the first preprinted product can take place, within the same processing operation, at any desired, later point in time. The desired arrangement of the printed products in the main product and/or the structure of the printed material can be obtained by virtue of such an insertion method.

In the case of that embodiment of the method according to the invention which is described hereinbelow, it is possible to select freely not just the point in time at which inserts are inserted into the first preprinted product, but also the point in time at which inserts are inserted into the second preprinted product.

In the case of this embodiment of the method which is intended for inserting printed products into a folded main product and in the case of which at least one printed product which is formed as a folded preprinted product and then further printed products are inserted, a first folded preprinted product is inserted into an open main product, it being the case that the preprinted product either is inserted in the closed state or is closed following the insertion operation, and subsequently at least a second folded preprinted product, which comes to rest alongside the closed, first preprinted product, is inserted in the closed state or is closed following the insertion operation. The method proceeds such that, following these actions, both the first preprinted product and the second preprinted product are in an arrested state, and in which [sic] at least one further printed product, which comes to rest alongside the arrested, first preprinted product and/or alongside the arrested, second preprinted product, can be inserted. At this stage of the method, of course, it is also possible for a plurality of further printed products to be inserted with any desired structuring.

Depending on the printed material which is to be produced, the main product may be configured as a main part, a cover or a frontispiece.

Following the insertion of said further printed product or of said further printed products, the first or second preprinted product can be opened and at least one further printed product can be inserted into the first or second preprinted product, whereupon the second or first preprinted product may then be opened and at least one further printed product may be inserted into the second or first preprinted product. It is thus possible for both the first preprinted product and the second preprinted product to have inserts or further printed products inserted into them at any desired points in time.

A printed product may be arrested in an open position or in a closed position. In particular it is possible, once the first preprinted product and the second preprinted product have been arrested in a closed position, for a third preprinted product, which comes to rest between the arrested preprinted products to be inserted and, in turn, to have printed products or inserts inserted in it. This then produces printed materials in the case of which a total of three preprinted products, located one beside the other, are contained within one product, it being possible for each of these preprinted products to have printed products or inserts inserted into them individually.

The method according to the invention may be implemented by a wide range of different apparatuses for putting together printed material. It is thus possible, for example, for the main product to be retained in a pocket during the insertion operations, it being possible in each case for a plurality of pockets to be arranged one beside the other or one behind the other. In this case, the pockets, which are arranged one beside the other and/or one behind the other, can be moved by means of a drawing means or other drive means along a path which is linear at least in certain sections or else along a curved path. When the pockets are moved along a curved path, it is advantageously possible to achieve the situation where, when subjected to the action of the drawing means, the pockets execute one or more tilting movements, which can cause the main and/or preprinted products to be opened. It is also possible for the pocket to be connected to the drawing means in a pivotable manner and to execute a tilting movement, for example, as a result of the action of a guide.

It is also possible for the pockets, which are arranged one beside the other, to be coupled to a rotating drum, rather than use being made of a drawing means, with the result that, when the drum rotates, the pockets essentially execute a movement along a circular or helical line or a combination of circular and helical lines. Tilting of the pockets, which makes it possible to achieve said opening movements, also takes place in the case of such an arrangement.

It is also possible for the pockets to be configured as elongate pockets and for the printed products which are located in said pockets to be moved by means of grippers or pushers in a conveying direction. Said elongate pockets may be mounted pivotably or else may be coupled to a rotating drum, with the result that the printed products which are conveyed in the rotating, elongate pockets essentially execute a movement along a circular or helical line or a combination of circular and helical lines.

It is possible; according to the invention, for the preprinted products, which are to be arrested and then opened, to be inserted directly into the main product, with the result that the main product and preprinted product are in contact with one another immediately following the insertion operation. This makes it possible for an apparatus for carrying out the method according to the invention to be configured in a particularly straightforward manner since it is not necessary, for example, to use double-walled pockets or pockets having a plurality of sections nested one inside the other. Rather, it is sufficient to use straightforward pockets having just a single inlet section and also just a single wall.

The preprinted product arrested according to the invention or the preprinted products arrested according to the invention is/are preferably opened by means of an overfold. Such an overfold allows that side of the preprinted product which has the overfold to be lifted off or moved away, by suitable means, from that side of the preprinted product which does not have any overfold, as a result of which the preprinted product may finally be opened.

Further preferred embodiments of the method according to the invention are described in the subclaims.

Figure 2:
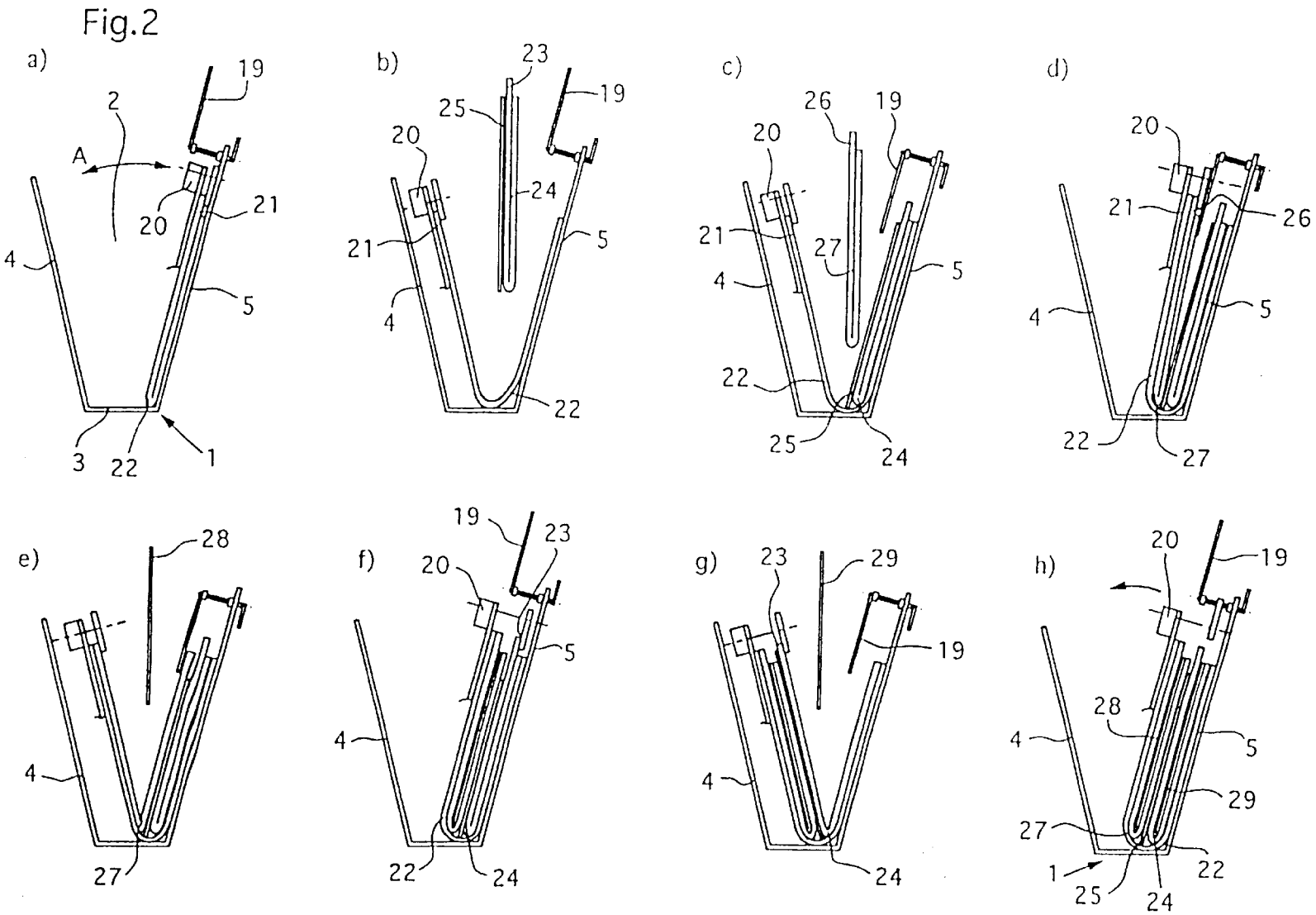
Figure 3:
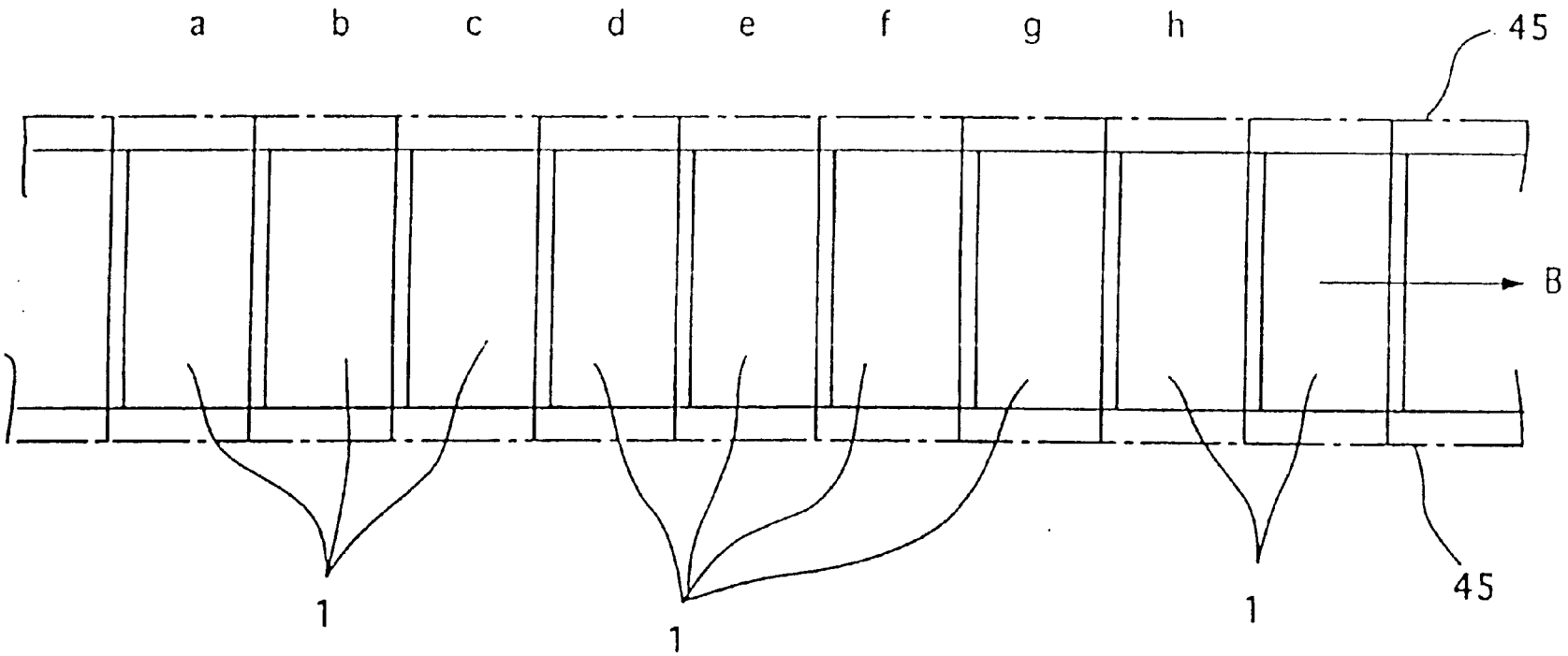
Figure 4:
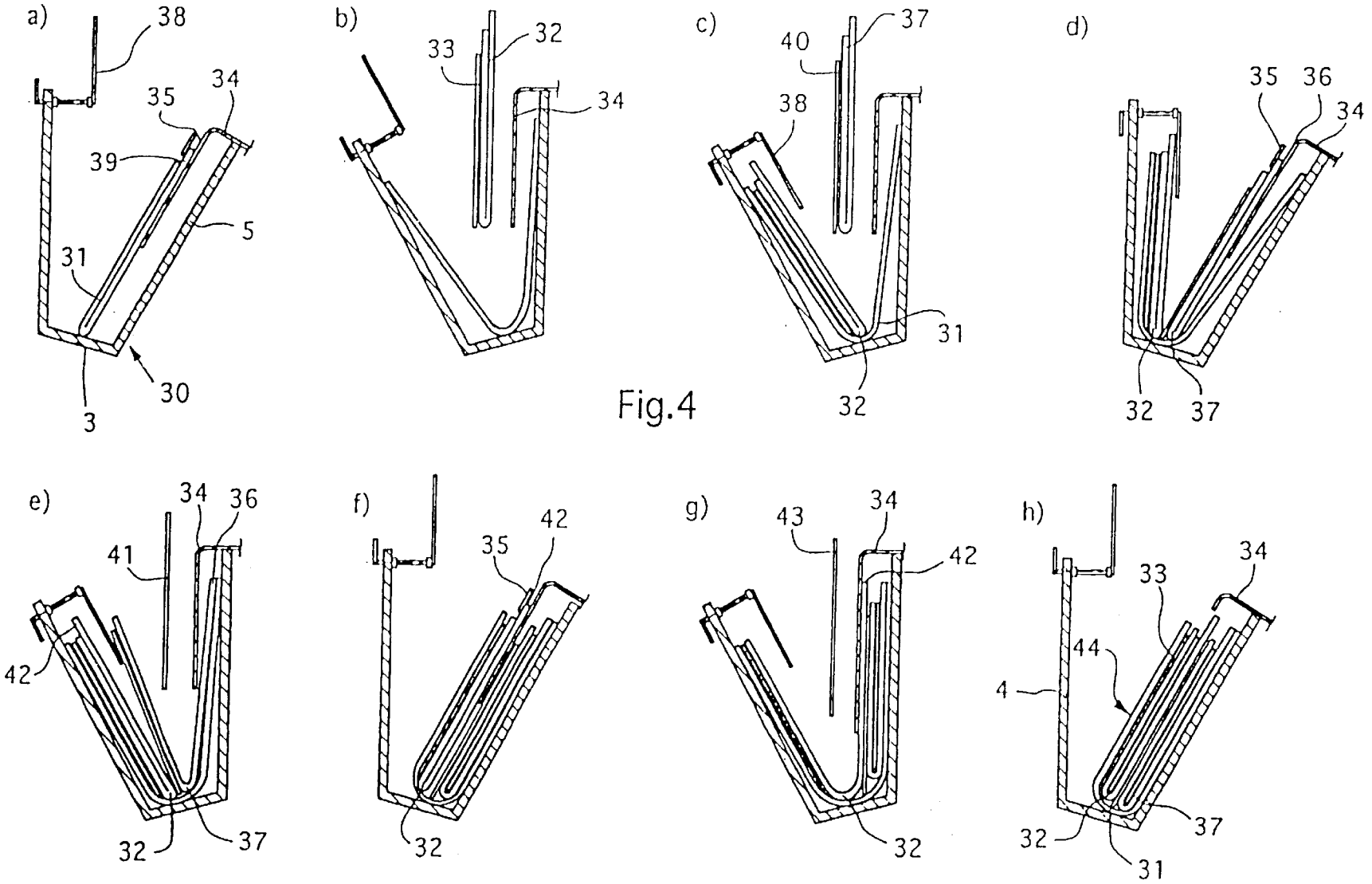

The invention is explained hereinbelow using exemplary embodiments and with reference to the drawings, in which:

FIGS. 1*a*–1*h* show a schematic illustration of different method steps as the method according to the invention is implemented using a first apparatus suitable for this purpose, FIGS. 2*a*–2*h* show a schematic illustration of different method steps as the method according to the invention is implemented using a second apparatus suitable for this purpose, FIG. 3 shows a schematic plan view of an apparatus according to FIG. 1 or FIG. 2, FIGS. 4*a*–4*h* show a schematic illustration of different method steps as the method according to the invention is implemented using a third apparatus suitable for this purpose, and FIGS. 5*a*–5*b* show a schematic plan view of an apparatus according to FIG. 4.

FIG. 1 illustrates a pocket 1 which has an interior 2 for receiving printed products and which can execute tilting or pivoting movements, about an axis running perpendicularly to the plane of the drawing, corresponding to the positions illustrated in FIGS. 1*a*)–1*h*). These tilting or pivoting movements are preferably produced, in a manner already explained above, in that the pocket 1 is moved along a curved path, in the [sic] the conveying path has a curved progression which is followed by the movement of the pocket 1, or in the [sic] the pocket 1 is connected pivotably to the conveying path and is moved in a controlled manner, for example, by guides. It is also possible for the pocket to be coupled to a rotating drum.

The interior 2 of the pocket 1 is bounded by a base surface 3 and two side walls 4, 5 which adjoin said base surface 3 and run in the form of a V in relation to one another.

Arranged at that end of the left-hand side wall 4 which is directed away from the base surface 3 is a product-retaining element 6 which can be pivoted, as required, between an active position (e.g. FIG. 1*c*), in which it causes at least one printed product to be restrained, and a passive position (e.g. FIG. 1*a*).

Provided at that end of the right-hand side wall 5 which is directed away from the base surface 3 is an overfold-retaining element 7 which is designed such that it can restrain the overfold region of printed products. It is also possible for this overfold-retaining element 7 to be pivoted, as required, between an active position (e.g. FIG. 1*a*), in which it causes at least one overfold to be restrained, and a passive position (e.g. FIG. 1*h*).

The product-retaining element 6 and the overfold-retaining element 7 differ essentially by the fact that, in contrast to the overfold-retaining element 7, the product-retaining element 6 can also restrain printed products without an overfold since, in its active position, it extends further in the direction of the base surface 3 than does the overfold-retaining element 7.

That sequence for a method of putting together printed material which is illustrated in FIG. 1 will be described hereinbelow:

According to FIG. 1*a*, there is inserted into the pocket 1 a folded main product 8 which, in the finished printed material (end product), finally comes to rest on the outside and, on account of corresponding tilting of the pocket 1, comes to rest on the right-hand side wall 5 in the closed state. The main product 8, which could also be a cover, is provided with an overfold 9 which is fixed by the overfold-retaining element 7. In the position shown in FIG. 1*a*, that side of the folded main product 8 which has the overfold 9 is directed toward the right-hand side wall 5, while that side of the folded main product 8 which does not have any overfold 9 is directed toward the left-hand side wall 4.

According to FIG. 1*b*, the next step to take place is tilting of the pocket 1 in the anticlockwise direction, with the result that the side of the main product 8 which does not have any overfold 9 is pivoted in the direction of the left-hand side wall 4 until it comes into abutment there. This movement opens the main product 8.

According to FIG. 1*b*, at least one first printed product which is formed as a folded preprinted product 11 having an overfold 10 is inserted into the open main product 8 together with an insert 12, which is located alongside the preprinted product 11.

The preprinted product 11 and insert 12 then tilt together, on account of the oblique position of the pocket 1, into the position depicted in FIG. 1*c*, i.e. in the direction of the left-hand side wall 4. Following this tilting operation, the product-retaining element 6 is pivoted downward in the direction of the base surface 3, as is illustrated in FIG. 1*c*. In this position, the product-retaining element 6 prevents the printed products 11, 12, which are located between the product-retaining element 6 and the left-hand side wall 4, and that half of the printed product 8 which is located there from tilting when the pocket 1 is pivoted out of the position shown in FIG. 1*c* into the position shown in FIG. 1*d*.

In the positions shown in FIGS. 1*c* to 1*e*, the preprinted product 11 is located in its arrested position.

In the case of the method step according to FIG. 1*c*, at least one second printed product which is a folded preprinted product 14 having an overfold 13 is inserted into the main product 8 together with an insert 15, which is located alongside the preprinted product 14, such that the preprinted product 14 comes to rest alongside the preprinted product 11.

During the subsequent tilting operation of the pocket 1 into the position illustrated in FIG. 1*d*, the closed preprinted product 14 is pivoted, together with the insert 15, in the direction of the right-hand side wall 5, where the insert 15 comes to rest on that section of the main product 8 which has the overfold 9. Following this pivoting movement, the overfold-retaining element 7 is changed over such that it retains not just the overfold 9 of the main product 8, but also the overfold 13 of the preprinted product 14, in the region of the right-hand side wall 5 of the pocket 1.

By virtue of a further tilting operation of the pocket 1 in the anticlockwise direction, into the position illustrated in FIG. 1*e*, that section of the preprinted product 14 which does not have any overfold 13 is pivoted in the direction of the left-hand side wall 4, as a result of which the preprinted product 14 passes into an open state. By virtue of the product-retaining element 6 being pivoted briefly from its active position into its passive position and back again, this operation taking place between the method steps according to FIGS. 1*d* and 1*e*, that section of the preprinted product 14 which does not have any overfold 13 passes into the region between the product-retaining element 6 and left-hand side wall 4.

Inserted into the preprinted product 14, which is open in FIG. 1*e*, is a further fourth printed product, folded printed product 16, which does not have any overfold, together with an insert 17, which is located alongside said printed product 16.

Following this insertion operation, the pocket 1 is tilted in the clockwise direction into the position illustrated in FIG. 1*f*, in this case the product-retaining element 6 being pivoted simultaneously into its passive position, as a result of which those elements which are positioned between the product-retaining element 6 and left-hand side wall 4 are released and it is possible to execute a pivoting movement in the direction of the right-hand side wall 5.

According to FIG. 1*f*, the overfold-retaining element 7 is changed over such that it then restrains the overfold 10 of the preprinted product 11. In the position illustrated in FIG. 1*f*, the overfolds 9, 10 and 13 are thus located between the overfold-retaining element 7 and right-hand side wall 5.

The pocket 1 is then tilted in the anticlockwise direction into the position illustrated in FIG. 1g, that section of the preprinted product 11 which does not have any overfold 10 being pivoted in the direction of the left-hand side wall 4. Once this pivoting movement has been executed, the preprinted product 11 is open.

Once said pivoting movement has been executed, the product-retaining element 6 is moved into its active position, with the result that that section of the preprinted product 11 which does not have any overfold 10, the insert 12 and that section of the main product 8 which does not have any overfold 9 are fixed between the product-retaining element 6 and left-hand side wall 4. In that position of the pocket 1 which is illustrated, it would also be possible for the product-retaining element 6, as is illustrated in FIG. 1*b*, to remain in the passive position if the gravitational force which is active in the position illustrated ensures that the open state remains until the printed product 18 has been inserted.

In the open state of the preprinted product 11, which is illustrated in FIG. 1*g*, at least one third printed product 18, which does not have any overfold, is inserted into the preprinted product 11.

By virtue of a subsequent pivoting operation of the product-retaining element 6 into its passive position and a likewise occurring tilting operation of the pocket 1 in the clockwise direction into the position illustrated in FIG. 1*h*, and by virtue of a pivoting operation of the overfold-retaining element 7 into its passive position, the finished printed material (end product) is released for a removal operation (not illustrated).

The finished printed material, which is illustrated in FIG. 1*h*, is distinguished in that arranged in a main product 8 are two preprinted products 11, 14 which are located one beside the other and into which respectively further printed products 18 and 16 and 17 are inserted. It is advantageous, in particular, that, rather than taking place immediately following the insertion operation of the preprinted product 11, the insertion operation of the printed product 18 can take place at any desired, later point in time. Of course, the printed material illustrated is only one exemplary embodiment taken from a large number of possible ways of putting together printed material comprising a main product 8 and preprinted products 11, 14, further printed products 16, 17, 18 and inserts. It would also be possible for the printed products, inserts and preprinted products inserted to be of a wide range of different sizes.

FIG. 2 shows the sequence for a method according to the invention in an apparatus in which the pockets 1 do not tilt.

The pockets 1 are constructed in accordance with the pockets illustrated in FIG. 1, for which reason use is made analogously of the designations 2, 3, 4 and 5 for the interior, the base surface, the left-hand side wall and the right-hand side wall.

Arranged at that end of the right-hand side wall 5 which is directed away from the base surface 3 is a product-retaining element 19 which can be pivoted, as required, between an active position (e.g. FIG. 2*c*), in which it causes at least one printed product to be restrained, and a passive position (e.g. FIG. 2*b*).

Also provided in the region of the pocket 1 is a gripper 20 which can be pivoted in the direction of the arrow A between the right-hand side wall 5 and the left-hand side wall 4. The gripper 20 is designed such that it can retain merely the overfold region of printed products, in the position illustrated in FIG. 2*a,* for example, it can retain the overfold 21 of a main product 22.

In the position shown in FIG. 2*a*, the main product 22 has been introduced into the pocket 1 and is in its closed state. With the product-retaining element 19 located in its passive position, a movement of the gripper 20 in the direction of the left-hand side wall 4 pivots that section of the main product 22 which has the overfold 21 in the direction of the left-hand side wall 4, as a result of which the main product 22 is opened.

In this open position of the main product 22, according to FIG. 2*b*, a folded preprinted product 24 having an overfold 23 is inserted into the main product 22 together with an insert 25.

According to FIG. 2*c*, the preprinted product 24 and insert 25 then tilt in the direction of the right-hand side wall 5, whereupon the product-retaining element 19 is pivoted into its active position, with the result that that section of the main product 22 which does not have any overfold, the preprinted product 24 and the insert 25 are retained between the product-retaining element 19 and right-hand side wall 5.

In this position, a further, folded preprinted product 27, which has an overfold 26, is inserted and comes to rest on the left alongside the insert 25.

In the positions according to FIGS. 2*c* to 2*f*, the preprinted product 24 is located in an arrested position.

Following the preprinted product 27 being inserted into the main product 22, the gripper 20 pivots in the direction of the right-hand side wall 5, where, in addition to the overfold 21 of the main product, it also grips the overfold 26 of the preprinted product 27. This state is illustrated in FIG. 2*d.*

The gripper 20 then pivots, together with those sections of the main product 22 and of the preprinted product 27 which respectively have an overfold 21 and 26, in the direction of the left-hand side wall 4, as a result of which the preprinted product 27 is opened according to FIG. 2*e.*

In this position, an insert 28 can be inserted into the preprinted product 27.

Following this insertion operation, corresponding to FIG. 2*f*, the gripper 20 is pivoted in the direction of the right-hand side wall 5, as a result of which the main product 22, with the printed product inserted therein, is closed. The gripper 20 is then changed over such that it grips not only the overfold 21 and the overfold 26, but also the overfold 23 of the arrested preprinted product 24.

When the gripper 20 is moved from the position illustrated in FIG. 2*f* into the position illustrated in FIG. 2*g,* i.e. in the direction of the left-hand side wall 4, the preprinted product 24 is opened, with the result that a further insert 29 can be inserted into the preprinted product 24.

When the gripper 20 is moved from the position illustrated in FIG. 2f in the direction of the left-hand side wall 4, according to FIG. 2*g*, the product-retaining element 19 has to be moved into its passive position, with the result that that section of the preprinted product 24 which has the overfold 23 can be pivoted in the direction of the left-hand side wall 4.

Subsequently, according to FIG. 2*h*, the gripper 20 is pivoted in the direction of the right-hand side wall 5, with the result that the finished printed material butts against the right-hand side wall 5. Finally, both the product-retaining element 19 and the gripper 20 are moved into the passive position, with the result that the finished printed material can be removed from the pocket 1.

The method illustrated in FIG. 2 ultimately produces printed material in the case of which two preprinted products 24 and 27 which are located one beside the other come to rest within a main product 22, an insert 25 being arranged between the two preprinted products 24, 27. An insert 29 and 28 is respectively inserted into each of the two preprinted products 24 and 27. It is advantageous that, rather than taking place immediately following the insertion operation of the preprinted product 24 into the main product 22, the insertion operation of the insert 29 into the preprinted product 24 can take place at a later point in time.

FIG. 3 shows a schematic plan view of an apparatus for implementing the method illustrated by means of FIG. 1 and FIG. 2. The pockets 1 are arranged such that they run perpendicularly to the conveying direction B and are conveyed by a drawing or drive means 45 in the direction of the arrow B. FIG. 3 shows a row of pockets 1 which are arranged one beside the other, adjoin one another and are conveyed in the direction of the arrow B, in particular along a circulatory path.

During one circuit, the pockets 1 thus run through a plurality of positions a to h, in which the method steps a to h according to FIG. 1 or FIG. 2 are carried out in each case. Pivoting of the pockets 1, which is illustrated in FIG. 1, can be produced, for example, in that the pockets 1 are connected fixedly to the drawing or drive means 45, it being the case that, in certain areas, the drawing or drive means 45 have a, for example, hump-like progression, which deviates from the horizontal direction, with the result that the pockets 1 assume the positions illustrated in FIG. 1. The pivoting of the pockets 1, which is illustrated in FIG. 1, can also be produced in that the pockets 1 are fastened pivotably on the drawing or drive means 45 and guides which are arranged along the conveying route and act on the pockets 1 bring about a pivoting operation.

Of course, in the direction running perpendicularly to the conveying direction B, it is also possible for a plurality of, for example, two or three, pockets 4 [sic] to be arranged one beside the other and to be conveyed by the same drawing or drive means 45.

FIG. 4 shows a schematic illustration of different method steps as the method according to the invention is implemented using a further apparatus, which differs from an apparatus according to FIG. 1 or FIG. 2 essentially in that in this case elongate pockets 30 are illustrated, said pockets, for example, being mounted pivotably or arranged on the circumference of a rotating drum (not illustrated) and printed products which are located in the pockets 30 being conveyed, by means of grippers or pushers (not illustrated either), in a direction parallel to the folding line of the respective product. Suitable grippers or pushers for producing said conveying movement are described, for example, in German Patent application DE 24 47 336.

The method illustrated in FIG. 4 puts together printed material which corresponds largely to he printed material which can be produced using a method according to FIG. 1 or FIG. 2.

Figure 5:
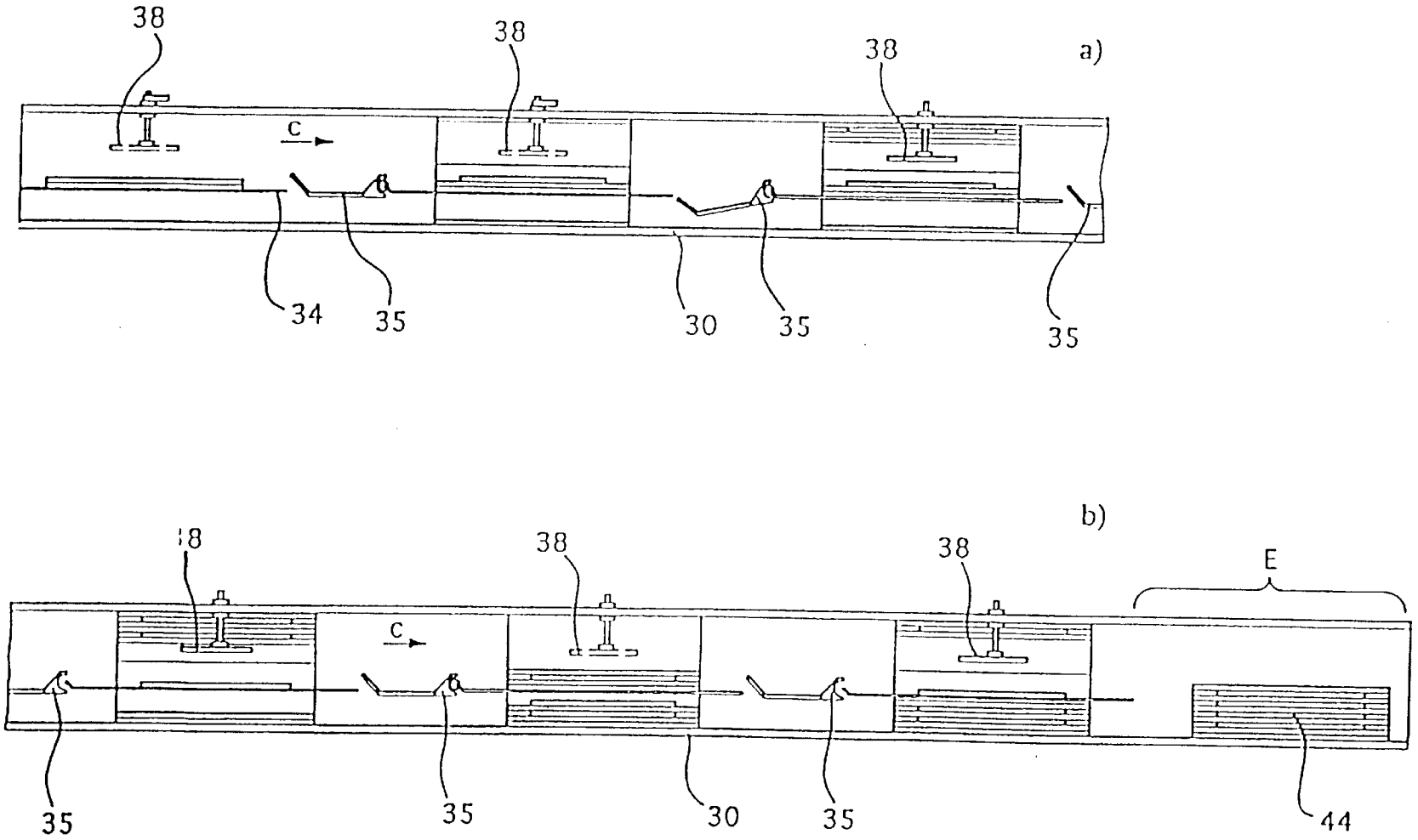

The construction of an apparatus for implementing the method according to FIG. 4 will now be described with reference to FIG. 4 and FIG. 5:

FIG. 4 shows the sectional view of an elongate pocket 30, while FIG. 5 illustrates the plan view of such an elongate pocket 30, the top part of FIG. 5 showing the left-hand part of the pocket 30 and the bottom part of FIG. 5 showing the right-hand part of the pocket 30.

Provided at the top end of the right-hand side wall 5 of the pocket 30 is a retaining plate 34 which is bent in the form of an L and of which the longer leg extends in the direction of the base surface 3 of the pocket 30. According to FIG. 5, the retaining plate 34 is interrupted a number of times in the longitudinal direction of the pocket 30 by pivotable opening elements 35.

These opening elements 35 serve for gripping the overfold of a printed product as the latter is conveyed in the direction of the arrow C according to FIG. 5, and for directing the same from a region in front of the retaining plate 34 to behind the retaining plate 34. This takes place, for example, with that section of the preprinted product 37 of FIG. 4 which has an overfold 36 as the printed products are moved from the position according to FIG. 4*d* into the position according to FIG. 4*e*.

The apparatus illustrated in FIGS. 4 and 5 is suitable merely for moving sections of preprinted products from a region in front of the retaining plate 34 to behind the retaining plate 34. However, it is likewise conceivable, in practice, for the purpose of providing further structuring options, also to provide apparatuses by means of which printed products or sections of printed products can be moved out of a position behind the retaining plate 34 into the region in front of the retaining plate 34.

In addition, the retaining plates 34 form a precisely defined product-guiding plane for the opening and introduction of a printed product.

At the top end of the left-hand side wall 4, a plurality of product-retaining elements 38 are spaced apart from one another in the longitudinal direction of the pocket 30, and these product-retaining elements are each designed in accordance with the product-retaining elements 6, 19 according to FIG. 1 and FIG. 2.

The operation of putting together printed material according to FIGS. 4 and 5 is merely described briefly hereinbelow since it corresponds essentially to the operation which has already been described with reference to FIGS. 1 and 2:

The overfold 39 of the main product 31 is directed behind the retaining plate 34 by means of a pivotable opening element 35 (FIGS. 4*a*, 4*b*), as a result of which the main product 31 is opened. According to FIG. 4*b*, a preprinted product 32 and an insert 33 are then inserted into the open main product 31. According to FIG. 4*c*, these inserted printed products 32, 33 are then retained behind the product-retaining element 38, whereupon a further preprinted product 37 and a further insert 40 are inserted into the main product 31.

According to FIGS. 4*d*, 4*e*, the overfold 36 of the preprinted product 37 is then directed behind the retaining plate 34 by means of the opening element 35. In addition, the pocket was tilted in the anticlockwise direction, as a result of which the preprinted product 37 is opened according to FIG. 4*e*.

An insert 41 is then inserted into said open preprinted product 37.

According to FIGS. 4*f*, 4*g*, the product part with the overfold 42 of the preprinted product 32, which is arrested in the positions 4*c* to 4*e*, is moved behind the retaining plate 34. By virtue of the pocket 1 being tilted in the anticlockwise direction, and by virtue of the product being conveyed simultaneously, the preprinted product 32 is then opened, it being possible, according to FIG. 4*g* for a further insert 43 to be inserted into said preprinted product 32.

The printed material 44 which has been put together in this way is then moved into a region E (FIG. 5) in which the retaining plate 34 either is no longer present or, according to FIG. 4*h* terminates above the preprinted material 44. It is possible for the finished printed material to be removed in this region.

The exemplary embodiment of an elongate pocket 30 which is illustrated in FIG. 4 requires a tilting or pivoting movement. However, it is also possible for the method according to the invention to function with a statically arranged, elongate pocket 30. An elongate pocket 30 according to the exemplary embodiment of FIG. 4 could be arranged in a fixed and immovable manner, for example, in a position which is rotated through 45 degrees in the clockwise direction in relation to the position illustrated in FIG. 4*a*. The pushers or grippers (not illustrated) for producing the conveying movement run along the base of the elongate pocket 30, arranged in the horizontal direction for example. A pocket 30 which arranged in this way has the property that, on account of the gravitational force which is active, all the printed product or parts of printed products located above the retaining plate 34 are always subjected to a force which acts in the direction of the retaining plate 34. Since the printed products can be displaced in the direction in which the elongate pocket 30 runs, use may be made of a so-called diverting plate which runs from the retaining plate 34 to the opposite wall of the elongate pocket 30, with the result that, during the conveying movement, the printed products resting on the retaining plate 34 are displaced in the direction of the opposite wall, and this produces an opening into which at least one additional printed product can be inserted. By virtue of a holding-open plate, which adjoins the diverting plate in the conveying direction, the printed products resting on said plate may be held open over a determinable length of the conveying route or over a determinable length in the elongate pocket 30. At the end of the holding-open plate, the open printed products are moved toward the retaining plate 34 on account of the gravitational force which is active. In the direction in which the elongate pocket 30 runs it is possible for a plurality of such diverting plates, as appropriate in combination with a holding-open plate, to be spaced apart one behind the other, and the size of the spacings is to be selected, in particular, such that a printed product moves away from the influence of the diverting plate or holding-open plate in such a spacing, and move toward the retaining plate 34. An elongate pocket 30 which is statically arranged in this way makes it possible to produce the same printed material 44 as is possible using a pivotable or tiltable elongate pocket 30 according to the exemplary embodiment of FIG. 4. Passively acting diverting and holding-open plates are used instead of the actively movable means.

The invention is not restricted to the exemplary embodiments described above; it is possible to realize a large number of other structuring options, for example by way of differently configured printed products, by way of a different sequence of insertion of the printed product, as far as timing or location is concerned, or by way of a suitable combination of retaining elements, grippers, retaining plates, diverting plates, holding-open plates and/or opening elements. Thus, in the exemplary embodiment according to FIG. 1, it would be possible for a number of product-retaining elements 6 and/or overfold-retaining elements 7 to be provided per pocket and to be controlled individually, this resulting in additional ways for printed products which are located in the pocket 1 to be opened at locations determined in each case by the product-retaining elements 6 or overfold-retaining elements 7. Likewise, in the exemplary embodiment according to FIG. 2, it would be possible for a number of grippers 20 and/or product-retaining elements 19 to be and [sic] provided and to be controlled individually.

What is claimed is:

1. A method of inserting printed products into a folded main product, wherein at least one printed product is formed as a folded preprinted product, comprising the following steps:

inserting into the main product at least one first printed product, which is formed as a folded preprinted product, in the closed state or closing said first printed product following the insertion operation;

inserting into the main product at least one second printed product such that it comes to rest alongside said at least one first printed product;

opening said at least one first printed products; and, inserting at least one third printed product into said at least one first printed product.

2. A method according to claim 1, further comprising the steps of:

inserting into said at least one second printed product a fourth printed product, wherein said at least one second printed product is a folded preprinted product.

3. A method according to claim 1, further comprising the steps of:

inserting into the main product said at least one second printed product, which is formed as a folded preprinted product, in the closed state or closing said second printed product;

inserting into the main product at least one further printed product such that it comes to rest alongside said at least one first and/or second printed product;

opening said at least one first printed product;

inserting at least one third printed product into said opened first printed product;

opening said at least one second printed product; and inserting at least one fourth printed product into said at least one second printed product.

4. A method according to claim 1, further comprising the steps of:

retaining the at least one inserted and closed first printed product in an arrested position by retaining means, before inserting further printed products into the at least one first printed product.

5. A method according to claim 1, wherein in the step of inserting into the main product at least one first printed product the main product is retained in a pocket during the insertion operations.

6. A method according to claim 1, wherein in the step of inserting into the main product at least one first printed product the at least one first printed product is inserted directly into the main product, with the result that the main product and the first printed product are in contact with one another immediately following the insertion operation.

7. A method according to claim 1, further comprising the step of:

inserting inserts, which are located alongside the first printed product, together with the first printed product.

8. A method according to claim 1, wherein in the step of inserting into the main product at least one first printed product said at least one first printed product is opened by an overfold means.

9. A method according to claim 8, further comprising the step of:

opening said first printed product by virtue of an overfold-retaining element that restrains its overfold and, under the action of gravitational force, by virtue of the respective pocket being tilted about an axis running essentially parallel to the folding line of the preprinted product.

10. A method according to claim 9, wherein in the step of opening said first printed product the overfold-retaining element restrains only the overfold region of printed products and/or preprinted products.

11. A method according to claim 9, further comprising the step of:

moving the overfold-retaining element between an active position, in which it causes at least one overfold to be restrained, and a passive position.

12. A method according to claims 9, further comprising the step of:

moving a product-retaining element, which is located on the side of the pocket opposite the overfold-retaining element, between an active position, in which it causes at least one printed product to be restrained, and a passive position.

13. A method according to claim 12, wherein in the step of moving a product-retaining element opposite the overfold-retainer element the product-retaining element also restrains printed products and/or preprinted products without an overfold.

14. A method according to claim 12, further comprising the step of;

arresting said first printed product in the closed state behind the product-retaining element, following the insertion operations;

releasing said first printed products by the product-retaining element after insertion of further printed products, which come to rest alongside the closed first printed product;

gripping said first printed product in the region of its overfold by the overfold-retaining element; and opening said first printed product by tilting the pocket.

15. A method according to claim 1, further comprising the step of:

opening said first printed product by gripping its overfold by means of a gripper and by pivoting the gripper about an axis running essentially parallel to the folding line of the preprinted product.

16. A method according to claim 15, wherein in the step of opening said first printed product the gripper retains only the overfold region of printed products and/or preprinted products.

17. A method according to claims 15, further comprising the step of:

changing over the gripper between an operating position in which it retains printed products and an operating position in which it releases printed products.

18. A method according to claims 15, wherein in the step of opening said first printed product the gripper retains one or more printed products or printed-product halves.

19. A method according to claims 15, further comprising the step of:

moving on one side of the pocket a product-retaining element between an active position, in which it causes at least one printed product to be restrained, and a passive position.

20. A method according to claim 19, wherein in the step of moving a product-retaining element the product-retaining element also restrains printed products and/or preprinted products without an overfold.

21. A method according to claim 19, further comprising the step of:

arresting said first printed product in the closed state behind the product-retaining element, following the insertion operation;

releasing said first printed products by the product-retaining element after insertion of further printed products, which come to rest alongside the closed first printed product;

gripping said first printed product in the region of its overfold by the overfold-retaining element; and opening said first printed product by virtue of a movement of the gripper.

22. A method according to claims 5, further comprising the step of:

moving the pockets, which are arranged essentially one beside the other, by a drawing or drive means along a path which is linear at least in certain sections or along a curved path.

23. A method according to claim 22, wherein in the step of moving the pockets the pockets, which are arranged essentially one beside the others move along a circular or helical line or along a combination of circular and helical lines, and they are preferably coupled to a rotating drum.

24. A method according to claim 1, further comprising the step of:

conveying the printed products during or between the insertion operations in elongate pockets by means of grippers or pushers, in a direction parallel to the folding line of the main product and/or the first printed product.

25. A method according to claim 24, further comprising the step of:

opening said first printed product by conveying past an opening element which is stationary in the conveying direction and moves an overfold of the preprinted product in the opening direction.

26. A method according to claim 1, further comprising the steps of:

inserting into the main product said at least one second printed product, which is formed as a folded preprinted product, in the closed state or closing said second printed product;

inserting into the main product at least one further printed product such that it comes to rest alongside said at least one first and/or second printed product;

opening said at least on second printed product;

inserting at least one fourth printed product into said opened second printed product;

opening said at least one first printed product; and inserting at least one third printed product into said at least one first printed product.

* * * * *

UNITED STATES PATENT AND TRADEMARK OFFICE

CERTIFICATE OF CORRECTION

PATENT NO. : 6,234,466 B1
DATED : May 22, 2001
INVENTOR(S) : Rudolf Infanger

It is certified that error appears in the above-identified patent and that said Letters Patent is hereby corrected as shown below:

ABSTRACT,
Line 6, change "product" to -- products --;
Line 10, change "open" to -- opened --.

Column 11, claim 1,
Line 22,change "products" to -- product --.

Column 12, claim 12,
Line 20, change "claims" to -- claim --.

Column 12, claim 17,
Line 54, change "claims" to -- claim --.

Column 12, claim 18,
Line 59, change "claims" to -- claim --.

Column 12, claim 19,
Line 62, change "claims" to -- claim --.

Column 13, claim 22,
Line 20, change "claims" to -- claim --.

Column 13, claim 23,
Line 27, after "pockets" (first occurrece), insert -- , -- (comma);
Line 28, change "others" to -- other, --.

Column 14, claim 26,
Line 22, change "on" to -- one --.

Signed and Sealed this

Fourth Day of December, 2001

*Attest:*

Nicholas P. Godici

*Attesting Officer*

NICHOLAS P. GODICI
*Acting Director of the United States Patent and Trademark Office*